US009303647B2

(12) United States Patent
Conway

(10) Patent No.: US 9,303,647 B2
(45) Date of Patent: Apr. 5, 2016

(54) CENTRIFUGAL PUMP ANTI-AIR LOCKING SYSTEM

(76) Inventor: Dale A. Conway, Port Orange, FL (US)

( * ) Notice: Subject to any disclaimer, the term of this patent is extended or adjusted under 35 U.S.C. 154(b) by 832 days.

(21) Appl. No.: 13/586,412

(22) Filed: Aug. 15, 2012

(65) Prior Publication Data

US 2013/0045081 A1 Feb. 21, 2013

Related U.S. Application Data

(60) Provisional application No. 61/523,478, filed on Aug. 15, 2011.

(51) Int. Cl.
*F04D 9/00* (2006.01)
*F04D 29/70* (2006.01)
*F04D 29/42* (2006.01)

(52) U.S. Cl.
CPC ..... *F04D 9/003* (2013.01); *F04D 29/708* (2013.01); *F04D 29/4213* (2013.01)

(58) Field of Classification Search
CPC ..... F04D 9/00; F04D 9/001; F04D 9/002; F04D 9/003; F04D 9/004; F04D 9/006; F04D 9/04; F04D 9/041; F04D 1/00; F04D 31/00; F04D 29/708
USPC ..... 415/56.1, 56.3, 169.1
See application file for complete search history.

(56) References Cited

U.S. PATENT DOCUMENTS 1,949,474 A 3/1934 Jacobsen
2,069,640 A 2/1937 Beardsley, Jr.
2,746,393 A 5/1956 Sway
3,115,098 A 12/1963 Berlyn
3,150,597 A 9/1964 Steenhagen
3,221,661 A 12/1965 Swearingen
3,246,605 A 4/1966 Fisher
3,692,420 A 9/1972 Mittelstaedt
3,823,063 A 7/1974 Callahan et al.
3,873,231 A 3/1975 Callahan
4,087,994 A 5/1978 Goodlaxson
4,269,564 A 5/1981 Naffziger
4,913,620 A 4/1990 Kusiak et al.
5,257,901 A 11/1993 Malchow
5,746,575 A 5/1998 Westphal et al.
5,921,748 A 7/1999 Frater
6,273,677 B1 8/2001 Wang et al.
2008/0008578 A1* 1/2008 Dossing ..... 415/169.1
2009/0280006 A1 11/2009 Thayer
2010/0061849 A1 3/2010 Visintainer et al.

* cited by examiner

*Primary Examiner* — Richard Edgar
(74) *Attorney, Agent, or Firm* — Robert M. Schwartz; Alfred K. Dassler

(57) ABSTRACT

A priming system for preventing air-locking for use on a centrifugal pump having a priming system with a two piece detachable design. This permits the upper portion of the priming system to be removed for routine maintenance. The lower portion of the priming system includes a plurality of primary stationary vanes located longitudinally in the flow path of multi-phase fluids (air and water) which permit the removal of trapped air. Additional removable secondary vanes are located in the flow path after the primary stationary vanes and prior to the intake structure of the centrifugal pump housing. Such multiple vane structure allows the centrifugal pump to pump multi-phase fluids during a wide variety of conditions without air-locking and without requiring any modifications to the centrifugal pump impeller.

34 Claims, 10 Drawing Sheets

CENTRIFUGAL PUMP ANTI-AIR LOCKING SYSTEM

PRIORITY TO RELATED APPLICATION

This application claims benefit of U.S. Provisional Application No. 61/523,478 filed Aug. 15, 2011, the disclosure of which is incorporated herein by reference in its entirety.

FIELD OF INVENTION

This invention relates to centrifugal pumps and particularly to an anti-air locking system for such a pump.

BACKGROUND OF THE INVENTION

Centrifugal pumps are well known devices employed to pump fluids from one location to another. Many pumps today are called upon to operate on critical projects over a wide range of capacities without any manual intervention. For these applications, the pumps must be able to operate continuously without interruption.

A common problem with centrifugal pumps is that they do a very poor job of pumping gas or multiphase fluids and can easily become air-locked or "vapor-locked" causing them to deliver reduced performance and ultimately lose prime without warning. Centrifugal pumps can become air bound from many sources such as vortexing from improper suction line submergence, leaks on the suction side of the pump, entrained air in the pumping fluid, cavitation due to poor suction conditions and from suction recirculation. Some of these problems can be controlled to some extent by various means but all of them cannot be completely eliminated.

Suction recirculation is one of the major causes of air-locking in centrifugal pumps and is very difficult to prevent. Suction recirculation is a phenomenon that occurs in all centrifugal pumps when operated at off-peak performance. The capacity at which suction recirculation occurs is directly related to the design suction specific speed of the pump. The higher the suction specific speed, the closer will be the beginning of recirculation to the capacity at best efficiency.

Suction recirculation is the reversal of flow at the impeller eye. At operation away from best efficiency, a portion of the flow is redirected out of the impeller eye (instead of through the impeller exit vane tips) in a swirling motion due to the mismatch between the incoming fluid flow and the rotation of the impeller inlet blades. The swirling fluid travels out of the impeller eye upstream of the impeller inlet into the suction piping causing a distortion of the fluid pressure field. In the fluid pressure field, the heavier fluid is thrown outward by the centripetal action of the rotating impeller blades while the lighter vapor (air) is centrifuged toward the center of rotation. This creates a vapor bubble or blockage directly in the eye of the impeller preventing any new liquid from passing through the eye to the discharge side of the impeller. At this point, the pump will stop pumping (lose prime) and is said to be air-locked. In addition to not being able to perform its required task of pumping the fluid, air-locking also causes excessive noise and vibration and can damage the internals of the pump. Damaging the internals of the centrifugal pump could include pitting the impeller, wear ring of casing, rupturing the mechanical seals, excessively loading the bearings or bending or breaking the pump shaft.

The problem with air locking is very common for pumps that are used on varying capacity applications with back pressure such as sewer bypass projects where the pump's pumping capacity can often exceed the incoming fluid rates (called "snore" condition) during non-peak hours and the pump is required to pump through a pressurized forcemain. When this occurs, the fluid level in the sump drops below the minimum submergence level of the suction entrance allowing air to enter the suction piping. The air in the suction piping reduces the overall flow rate into the pump causing the pump to undergo suction recirculation. Once the suction recirculation cycle begins, the pump is no longer able to develop enough centrifugal head to penetrate the forcemain and the pump becomes air bound.

DESCRIPTION OF PRIOR ART

Many attempts have been made to solve this dilemma with limited results.

One method that has been tried is to manually turn the centrifugal pump off thus breaking the suction recirculation cycle and allowing the trapped air at the inlet of the impeller to escape. The pump is then restarted and in theory, the pump should regain normal pumping. The problem is that in practice, this does not always work because the conditions that existed to air-lock the pump in the first place usually are still present and the pump soon air-locks again. Also this method requires manual intervention to be able to discover the problem and manually start and stop the pump. One method to remove the manual intervention component is to incorporate a device to detect whether the pump is air-locked and stop and start it automatically but this method still has the same problem of not changing the conditions for which the pump will continually air lock.

Another method that has been tried is to provide a vent line at the high point of the pump casing to release the trapped air from the impeller. The problem with this method is that while the pump is running, the pressure field around the inlet of the impeller traps the air bubble at the eye preventing it from escaping through to the pump casing.

Another method that has been tried is to provide a recirculation line from the pump discharge directly into the eye of the impeller to try to force the air bubble out of the eye. The problem with this idea is that there is not enough centrifugal head developed from the outlet of the impeller to overcome the dynamic head at the eye diameter to break up the air bubble.

Another method that has been tried is to add an external priming system such as a vacuum pump, venturi or diaphragm pump to the suction of the pump to automatically strip off any air before it enters the pump. The problem with these systems is that they are ineffective at capturing the entrained air within the fluid and they are not able to counteract the pressure field caused by suction recirculation to remove the trapped air in the center of rotation.

Another method that has been tried is to completely drain the discharge line each time the pump loses prime thus taking the backpressure off the pump and reducing the centrifugal head required by the impeller to move the air through to the discharge. The problem with this method is that it can only be applied to gravity systems where the discharge pressure can be reduced by stopping the pump and not pressurized discharge systems such as sewer force mains and other parallel pumping applications into the same discharge line.

Another method that has been tried is to place an inducer on the shaft directly in front of the impeller to boost the pressure at the eye of the impeller to theoretically force the air through the eye. The problem with this concept is that each inducer has to be specifically matched to the impeller inlet geometry and is only effective over a narrow capacity range. Operation outside this narrow range actually causes the problem to worsen.

Many attempts have been made to modify existing impellers or design new ones to try to release the air bubble at the eye by drilling vent holes in the eye, providing vent channels through the vanes or adding small projections from the vanes but these methods are ineffective in releasing the trapped air in the center of rotation during suction recirculation; they have a tendency to clog when handling stringy materials; they reduce the structural integrity of the impeller and they reduce the overall efficiency and performance of the pump.

Many attempts have been made to redesign the geometry of the impeller to change the suction specific speed but these modifications fail to be able to reproduce the same desired performance characteristics of the original impeller and only serve to move the range of the onset of suction recirculation and not totally eliminate it.

Since many of the above-mentioned problems cannot be totally eliminated, it would be an advantage in the art to provide a means of preventing conventional centrifugal pumps from air locking during any or all of these events.

SUMMARY OF THE INVENTION

A principle object of this invention is to prevent loss of prime or "air-locking" in a centrifugal pump.

Another object of the present invention is to enable a centrifugal pump to handle multi-phase fluids without air locking, losing performance or causing damage to the internal parts of the pump.

Another object of the present invention is to enable a centrifugal pump to handle fluids with low vapor pressures without air locking, losing performance or causing damage to the internal parts of the pump.

Another object of the present invention is to enable a centrifugal pump to handle multi-phase fluids without air locking, losing performance or causing damage to the internal parts of the pump without requiring constant monitoring or action by the operator.

Another object of the present invention is to enable a centrifugal pump to handle multi-phase fluids without air locking, losing performance or causing damage to the internal parts of the pump without requiring any external means such as vent lines, air release valves, discharge drain lines, etc.

Another object of the present invention is to enable a centrifugal pump to handle multi-phase fluids without air locking, losing performance or causing damage to the internal parts of the pump without requiring any modifications to the centrifugal pump impeller.

Another object of the present invention is to enable a centrifugal pump to handle multi-phase fluids without air locking, losing performance or causing damage to the internal parts of the pump while operating against a positive discharge head.

Another object of the present invention is to enable a centrifugal pump to handle multi-phase fluids without air locking, losing performance or causing damage to the internal parts of the pump while handling fluids containing solids and stringy material.

Another object of the present invention is to enable a centrifugal pump to operate during off-peak performance/suction recirculation without air locking.

Another object of the present invention is to enable a centrifugal pump to operate without air locking when the internal parts become worn and the clearance between the impeller and wear plate/rings increases.

Another object of the present invention is to enable a centrifugal pump to operate during "snore" conditions where air enters the suction line via the vortex created from improper suction line submergence in the sump without air locking.

Another object of the present invention is to enable a centrifugal pump to operate without air locking without causing adverse affects such as excessive suction pressure loss or reduction in flow to the centrifugal pump.

An object of the stationary vanes mounted in the centrifugal pump intake structure and priming chamber is to break up the swirling fluid that back flows from the suction eye of the impeller into the suction inlet by generating small vortices or swirls opposite to the main swirl. This produces rigorous cross stream mixing between the swirling fluid and main incoming fluid which breaks up the air pocket at the entrance of the impeller thus allowing the air to be effectively purged by the priming chamber.

An object of the present invention is that it has an automatic self cleaning feature in that as the centrifugal pump impeller becomes clogged with rags or stringy material, the flow to the impeller will be lessened and the pump will begin to operate farther and farther away from BEP (best efficiency point) causing the impeller to undergo suction recirculation. The force of the back flowing swirl of fluid from the impeller during this suction recirculation will then clear any debris from the impeller or stationary vanes.

BRIEF DESCRIPTION OF THE DRAWINGS

Preferred embodiments of the invention will hereinafter be described with reference to the accompanying drawing in which.

DETAILED DESCRIPTION OF THE PREFERRED EMBODIMENTS

Figure 1:
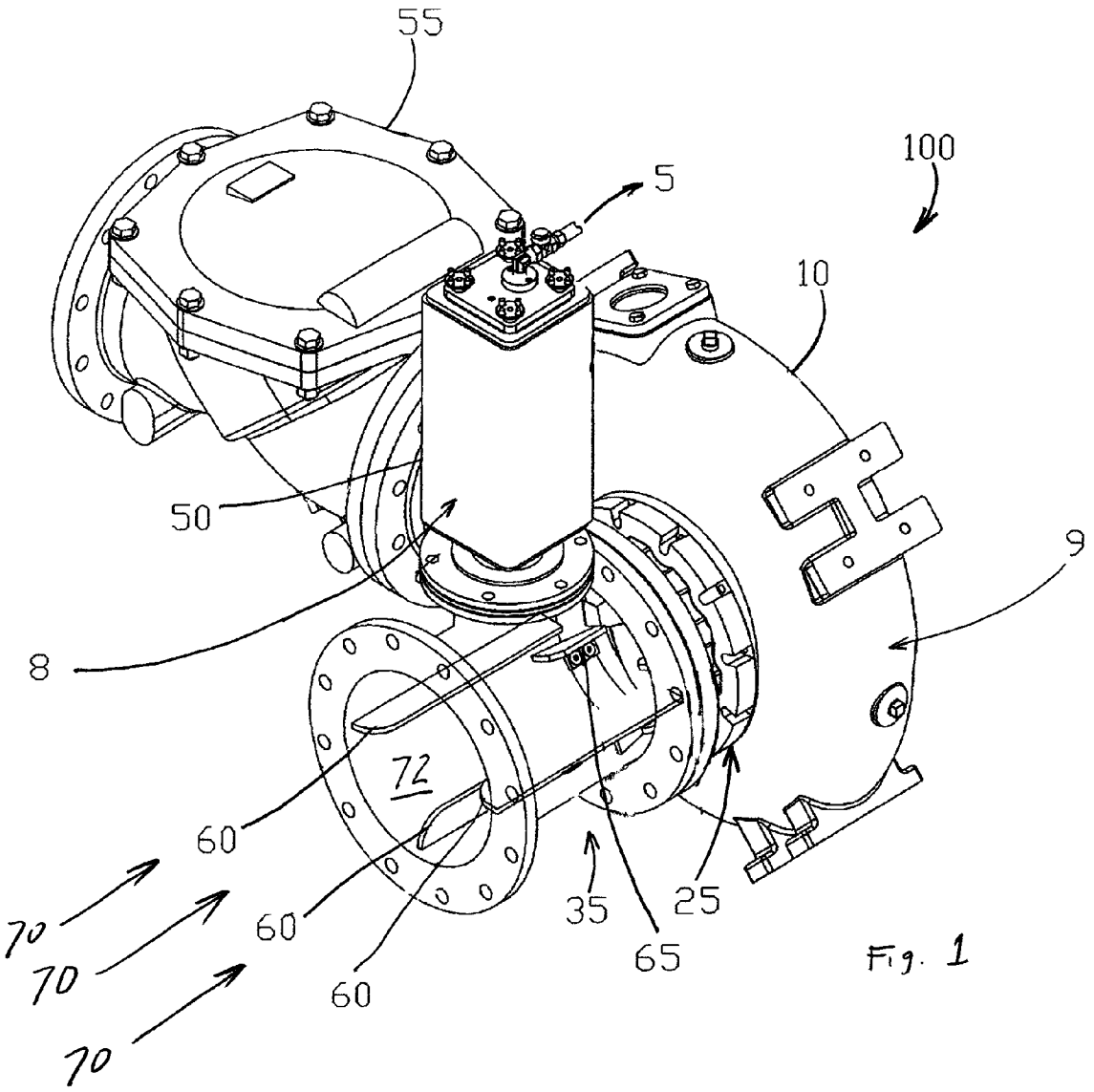
FIG. 1 is a perspective view of the elements of the present invention with the lower priming chamber and suction cover partially shown to view vanes therewithin.

A centrifugal pump system according to the present invention is shown generally at 100 in FIG. 1. Pump system 100 includes a centrifugal pump 9, a priming device 5, a priming chamber assembly 8 and discharge non return valve 55. The centrifugal pump 9 may contain a separate suction cover 25 or it can be an integral part of the pump casing 10 to permit the mounting of one or more strategically located replaceable anti-rotation vanes 65. The priming device 5 can consist of any vacuum producing mechanism including, but not limited to, a vacuum pump, venturi, or diaphragm primer. The priming chamber assembly 8 consists of two sections; an upper section 50 and lower section 35 so that the upper portion 50 may be removed to allow access to the pump for inspection, cleaning, maintenance, etc. The upper section 50 is attached to the top of the lower section 35 about midway of the length of the lower section 35 of the priming chamber assembly 8. However, certain embodiments may include the upper section 50 intersecting into the lower section 35 at any point along the length of the lower portion of the priming chamber 8. The lower portion 35 of the priming chamber assembly 8 contains one or more strategically located anti-rotation vanes 60 that are positioned relative to the anti-rotation vanes 65 in the centrifugal pump suction cover 25 or casing 10 to remove air and prevent the centrifugal pump 9 from air locking.

The size, shape, number and exact placement of the stationary anti-rotation vanes 60 and removable anti-rotation vanes 65 are determined based on the specific geometry of the centrifugal pump impeller. Test data appears to indicate that impellers with a higher rotational velocity require more anti-rotation vanes then those with a lower rotational velocity. One possibility for this outcome has to do with the higher energy required by impellers with greater rotational velocities to generate head (pressure) inside the pump casing due to the axial components of the flow vector. It is possible that other factors may play a part in this determination.

The stationary anti-rotation vanes 60 may also be referred to as the primary stationary vanes 60. The replaceable anti-rotation vanes 65 may also be referred to as secondary replaceable vanes 65. The lower section 35 may also be described as an intake plenum 35. The fluid flow 70 is shown entering the entrance of the lower section 72. The fluid flow 70 may include fluid 70 with entrained air along with other possible substances (not shown) which may include suspended dirt, rags or stringy material (not shown). The primary stationary vanes 60 includes a curved forward section 60*a* (best shown in FIG. 6) proximal to the entrance 72 of the lower section 35. The primary stationary vanes 60 with their curved forward section 60*a* help to prevent rags and stringy material from catching and accumulating on the surface, while the primary stationary vanes 60 aid in the removal of air to prevent the centrifugal pump system 100 from air locking.

Figure 2:
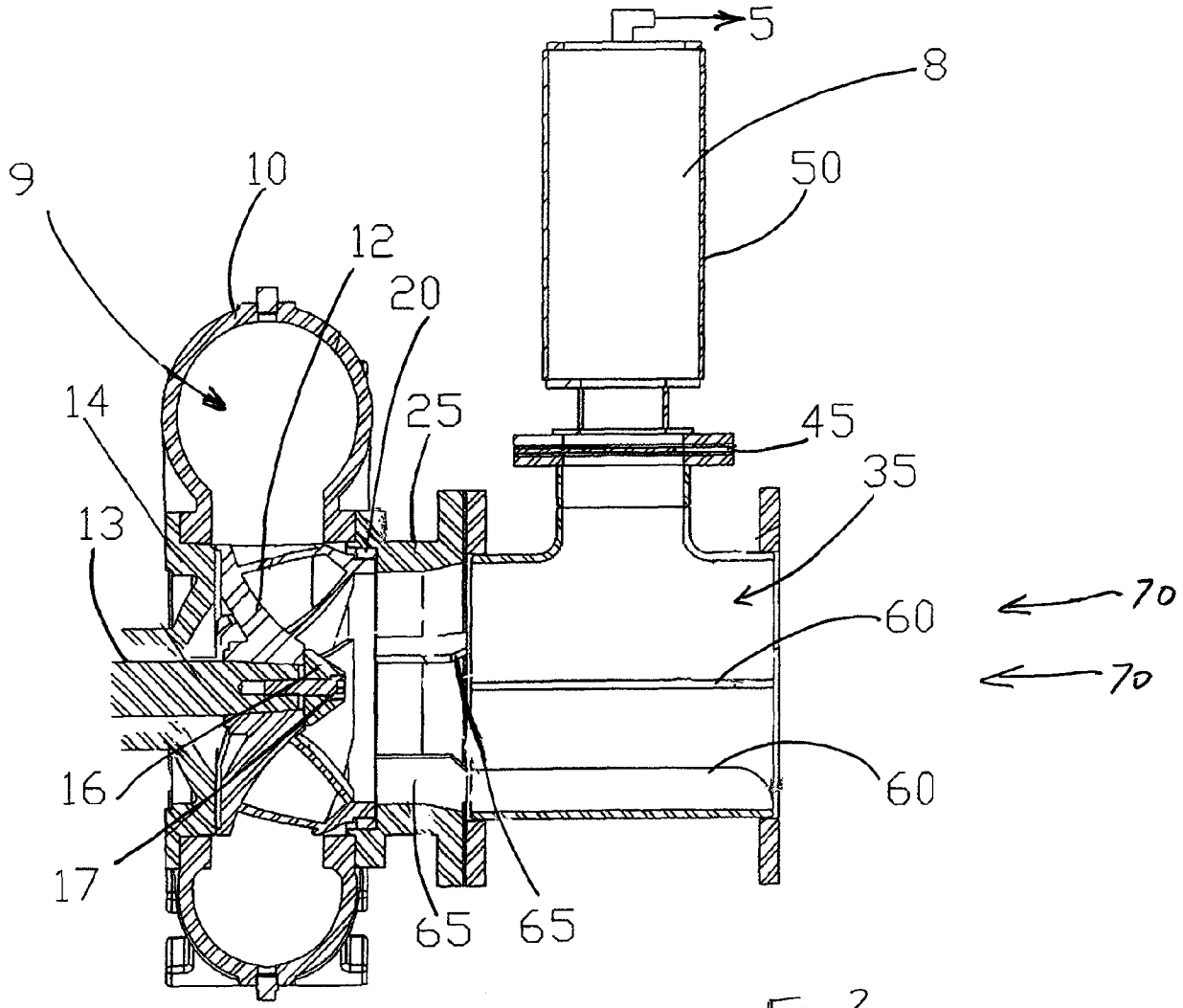
FIG. 2 is a longitudinal cross sectional view of the elements of the present invention.

As shown in FIG. 2, the centrifugal pump 9 is comprised of a shaft and bearing assembly 13 connected to an impeller 12 via a washer 16 and bolt 17. A pump casing 10 with replaceable wear ring 20, rear plate 14 and suction cover 25 is mounted to the shaft and bearing assembly 13. The suction cover 25 permits mounting of one or more replaceable strategically located anti-rotation vanes 65. In some embodiments the suction cover 25 may be an integral part of the pump casing 10. The priming chamber assembly 8 is comprised of an upper section 50 and lower section 35 with a removable baffle 45 in between to prevent any fluid from splashing into the upper section 50 and possibly passing through to the priming device 5. The lower section 35 of the priming chamber assembly 8 contains one or more strategically located anti-rotation vanes 60 that are positioned relative to the anti-rotation vanes 65 in the centrifugal pump suction cover 25 or casing 10, if suction cover 25 is integral to pump casing 10, to remove air and prevent the centrifugal pump 9 from air locking. In one embodiment, the lower section 35 has 3 vanes, these vanes are oriented with the flowing fluid which is heading to the suction cover 25 and then to the rotating pump impeller 12.

Figure 3:
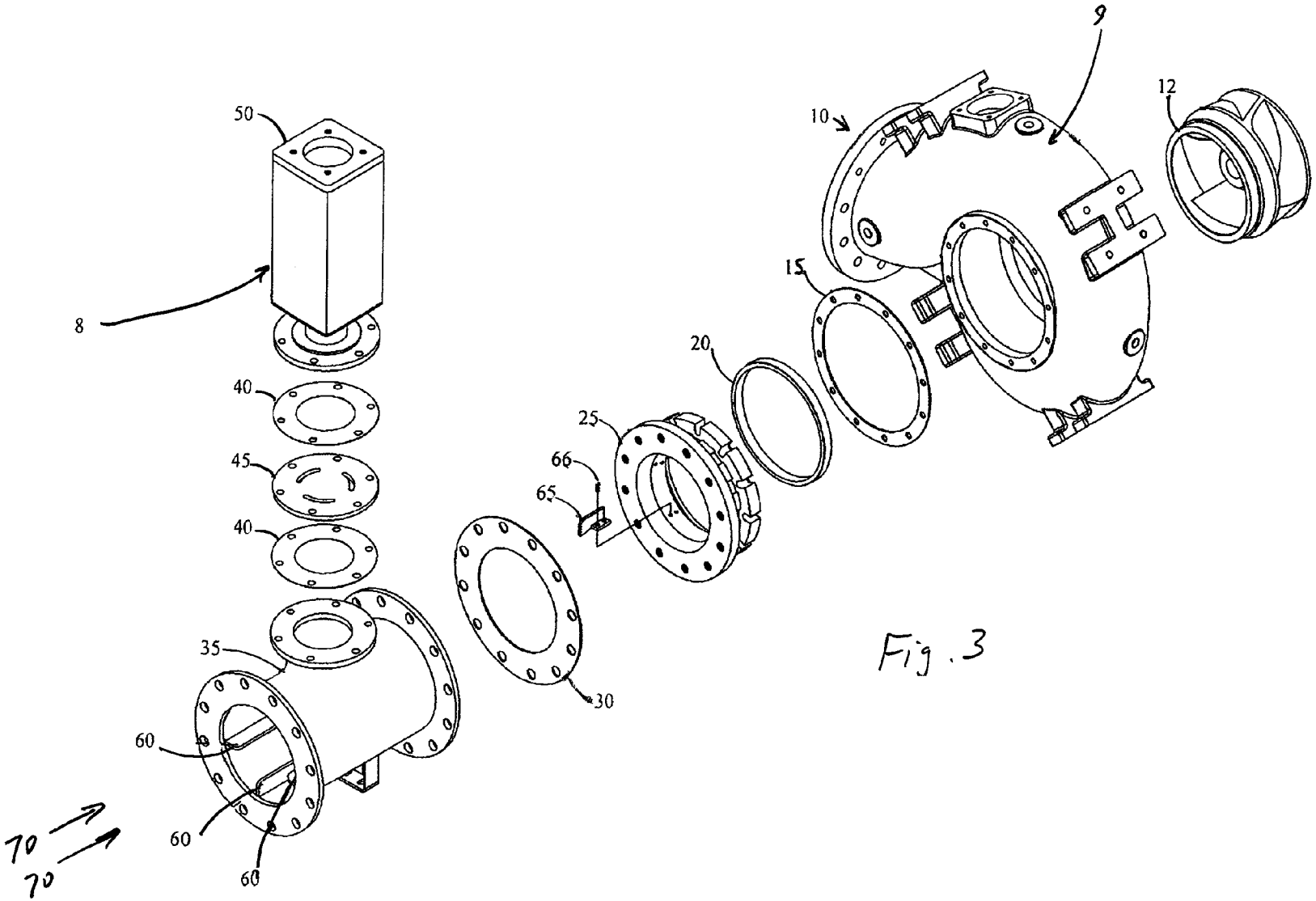
FIG. 3 is an exploded view of the elements of the present invention.

The centrifugal pump system 100 is shown with its components in an exploded perspective view in FIG. 3. The component assembly of the centrifugal pump 9 may generally comprise a rotating pump impeller 12, with pump casing 10, wear ring 20, suction cover gasket, 15 and suction cover 25. The suction cover 25 or casing 10 contains one or more replaceable strategically located anti-rotation vanes 65 and anti-rotation vane bolts 66 for fastening the anti-rotation vanes 65. The component assembly of the priming chamber assembly 8 may generally comprise an upper section 50, lower section 35, removable baffle 45 in between with gaskets 40. Intermediate the suction cover 25 and the lower section 35 is a lower section gasket 30. The lower section 35 may also be referred to as the input plenum 35. The lower section 35 of the priming chamber assembly 8 contains one or more strategically located anti-rotation vanes 60 that are positioned relative to the anti-rotation vanes 65 in the centrifugal pump suction cover 25 or casing 10 to remove air and prevent the centrifugal pump 9 from air locking.

Figure 4:
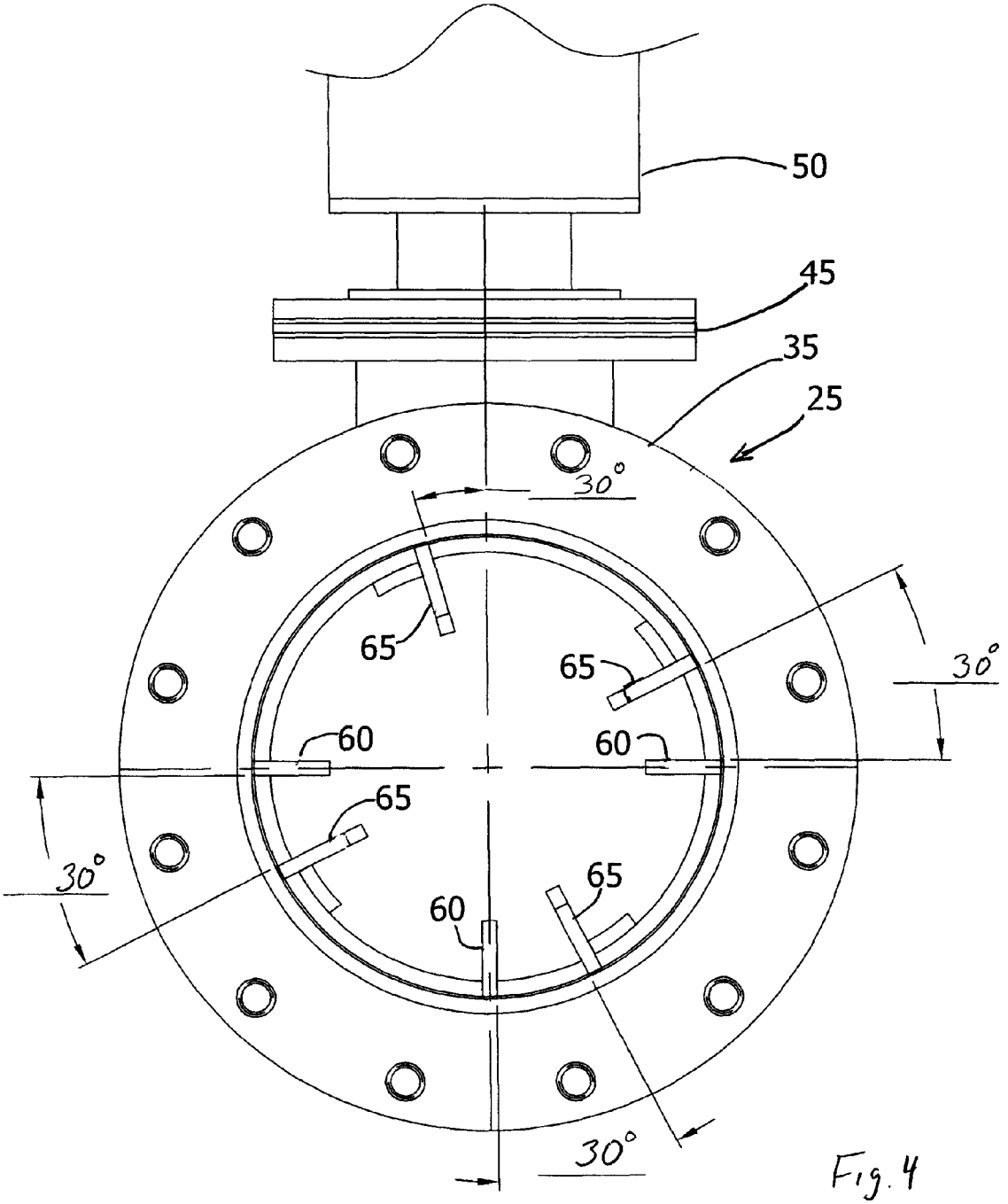
FIG. 4 is a partial view taken generally along line 1-1 in FIG. 3.

As best seen in FIG. 4, the replaceable anti-rotation vanes 65 in the suction cover 25 or pump casing 10 are positioned relative to the stationary anti-rotation vanes 60 in the lower section 35 of the priming chamber assembly 8. The lower section 35 of the priming chamber assembly 8 is connected to the upper section 50, and includes a replaceable baffle 45 sandwiched in between. The replaceable baffle 45 permits air to enter the priming system upper section 50 for removal, while allowing the water flow to continue into the rotating impeller 12. The size, shape, number and exact placement of the stationary vanes 60 and the replaceable vanes 65 are determined based on the specific geometry of the centrifugal pump impeller.

In one embodiment the geometry of the stationary anti-rotation vanes 60, are arranged such that the three longer vanes 60 affixed to the inner wall of the intake plenum or the priming device lower section 35 are arranged at the 3, 6 and 9 o'clock positions. In a circular cross-section of the priming device lower section 35, where 12 o'clock position is considered 0 (zero) degrees, the three longer vanes 60 would be located at 90 degrees, 180 degrees and 270 degrees in the clockwise direction respectively. It is to be understood that the plurality of longer vanes 60 may be positioned at other angular separations then discussed above and further the number of the plurality of longer vanes 60 is not limited to 3 (three).

In this embodiment, the four replaceable anti-rotation vanes 65 are affixed to the inner wall of the suction cover 25 are arranged at the 2, 5, 8 and 11 o'clock positions which appear to be a configuration which permits maximum effectiveness. In a circular cross section of the suction cover 25, where 12 o'clock position is considered 0 (zero) degrees, the four replaceable anti-rotation vanes 65 would be located at 60 degrees, 150 degrees, 240 degrees and 330 degrees in the clockwise direction respectively. This places the four replaceable anti-rotational vanes about 90 degrees apart from one another. It is to be understood that the plurality of shorter vanes 65 may be positioned at other angular separations then discussed above and further the number of the plurality of shorter vanes 65 is not limited to 4 (four).

It can be seen that the two types of anti-rotation vanes 60 and 65 are proximal to each other, and both are located joined to the wall of a specific pump intake structure in a radial fashion, both projecting outwardly into the fluid flow path 70, the primary stationary anti-rotation vanes 60 on the lower section 35 and the removable secondary anti-rotation vanes 65 on the adjacent suction cover 25, or in some embodiments in the entrance to the centrifugal pump housing itself.

Tests show that an acceptable range for the placement of the replaceable shorter anti-rotation vanes 65 relative to the longer anti-rotation vanes 60 is a about 15 to 35 degrees from each other. The optimum angle for the 2, 5 and 8 o'clock positions is about 30 degrees clockwise from the three longer anti-rotation vanes 60 and the shorter anti-rotation vane at 11 o'clock position is about 30 degrees from 12 o'clock position of the suction cover 25. It is to be understood that primary anti-rotation vanes 60 do not move.

The secondary anti-rotation vanes 65 are secured by mechanical fastener to the interior cylindrical sidewall of the suction cover 25. Once secured, the anti-rotation vanes 65 do not move either. They can be replaced or may be placed in another position, but once fastened they remain stationary.

Figure 5:
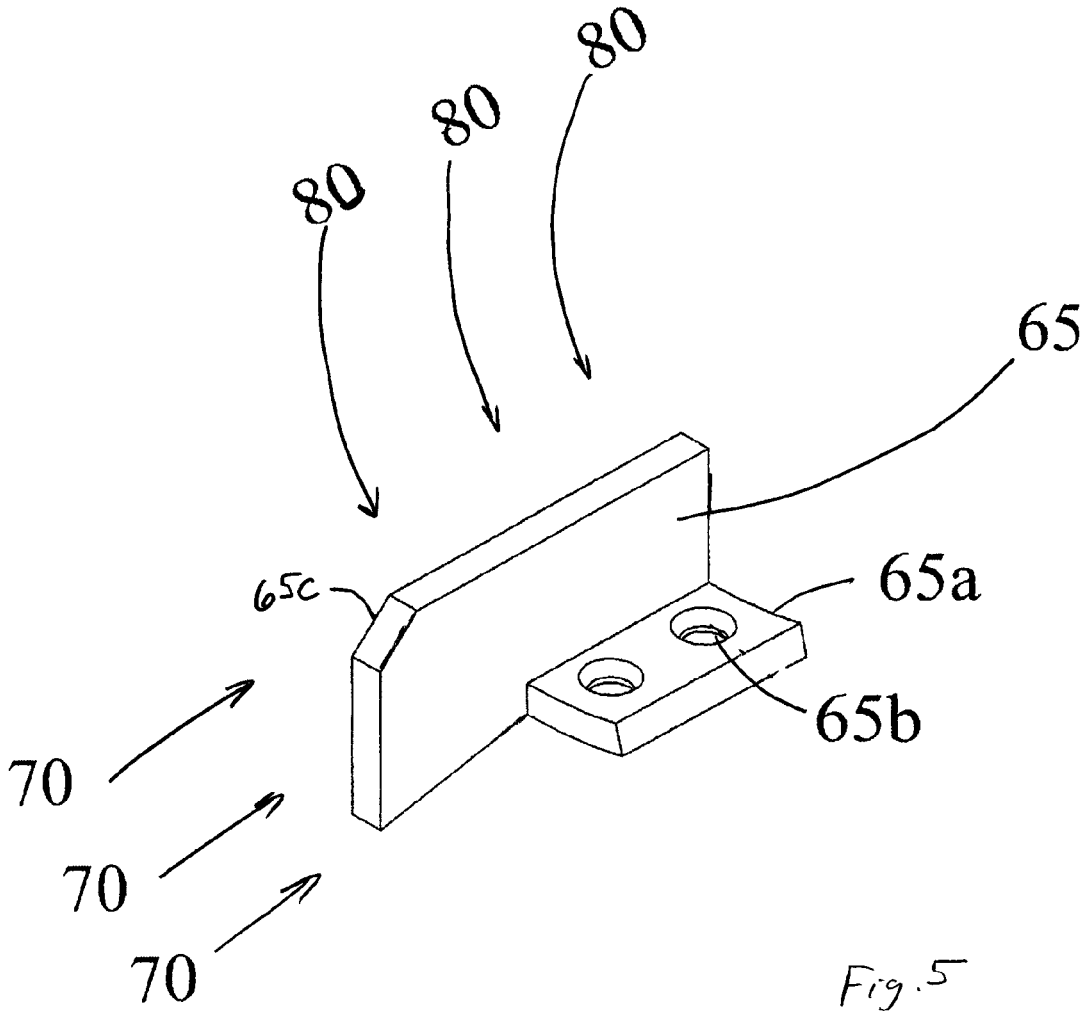
FIG. 5 is an illustration showing the direction of fluid flow across one of the replaceable secondary anti-rotation vanes of the present invention.

FIG. 5 shows the general configuration of the replaceable anti-rotation vane(s) 65 that are mounted in the suction cover 25 or pump casing 10 which contain a mounting pad 65*a* and one or more mounting holes 65*b*. The replaceable anti-rotation vane 65 includes a curved or angularly cut section at the entrance 65*c* to prevent rags or stringy materials from catching and accumulating on the surface. The size, shape, number and exact placement of the replaceable anti rotation vanes 65 are determined based on the specific geometry of the centrifugal pump impeller or other centrifugal pump system 100 considerations. This diagram also shows the relationship of the incoming fluid flow 70 and the rotating reversing flow of fluid 80 from the impeller 12 onto the anti-rotation vane 65.

Figure 6:
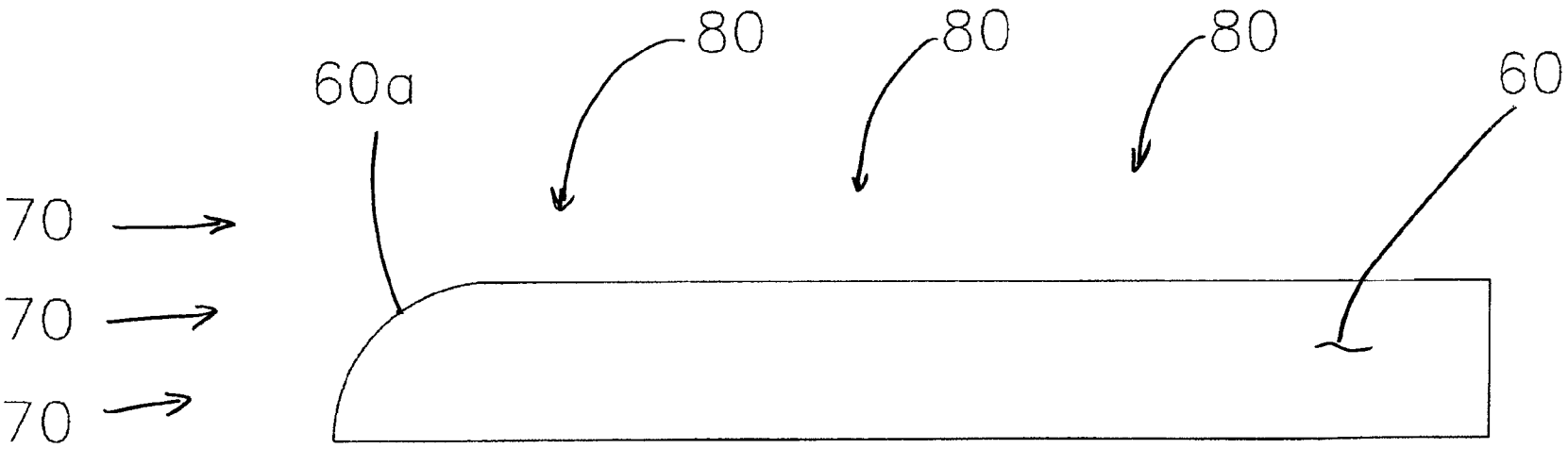
FIG. 6 is an illustration showing the direction of fluid flow across one of the stationary primary anti-rotation vanes located in the lower section of the priming assembly of the present invention.

FIG. 6 shows the general configuration of the stationary anti-rotation vane(s) 60 in the lower section 35 of the priming chamber assembly 8. The anti-rotation vane(s) 60 include a curved section at the entrance 60*a* to prevent rags and stringy materials from catching and accumulating on the surface. The size, shape, number and exact placement of the stationary vanes 60 are determined based on the specific geometry of the centrifugal pump impeller or other centrifugal pump system 100 considerations. This diagram also shows the relationship of the incoming fluid flow 70 and the rotating reversing flow of fluid 80 from the impeller 12 onto the anti-rotation vane 60.

Figure 7:
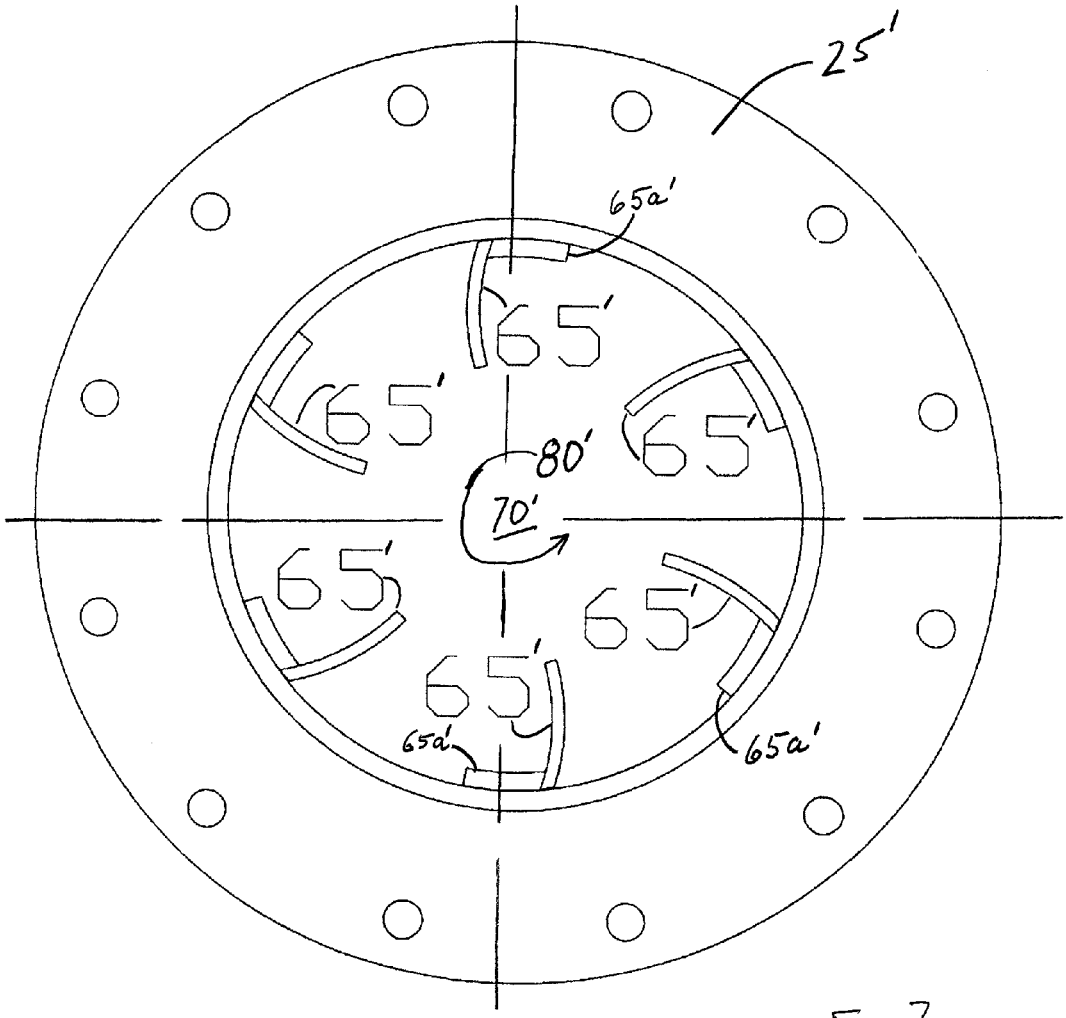
FIG. 7 is a partial view of another embodiment of the replaceable secondary anti-rotation vanes mounted in the pump suction cover of the present invention where the fluid flow 70' is directly into the suction cover 25'.

FIG. 7 shows another embodiment of the invention whereby the replaceable anti-rotation vanes 65' in the in the centrifugal pump suction cover 25' have a curved shape opposite of the direction to the swirling fluid 80' to create vortices which counteract the low pressure zone in the center of the fluid flow 70'. In FIG. 7 six of the smaller replaceable anti-rotation vanes 65' are shown each separated by 60 degrees. The number of smaller replaceable anti-rotation vanes 65 is not limited to 4 as shown in FIG. 4 or 6 as shown in FIG. 6, but is chosen appropriately to meet the requirements of the centrifugal pump system 100 and variances in the components thereof, such as the impeller. In FIG. 5, a replaceable anti-rotation vane 65 is shown and it should be noted that it does not have a curvature 65*d* (best seen in FIG. 8) as the replaceable anti-rotation vanes 65'. It is to be understood that circumstances may exist where a mixture of the 2 different replaceable anti-rotation vanes 65 and 65' may be desirable and such a configuration is contemplated as part of this invention.

Figure 8:
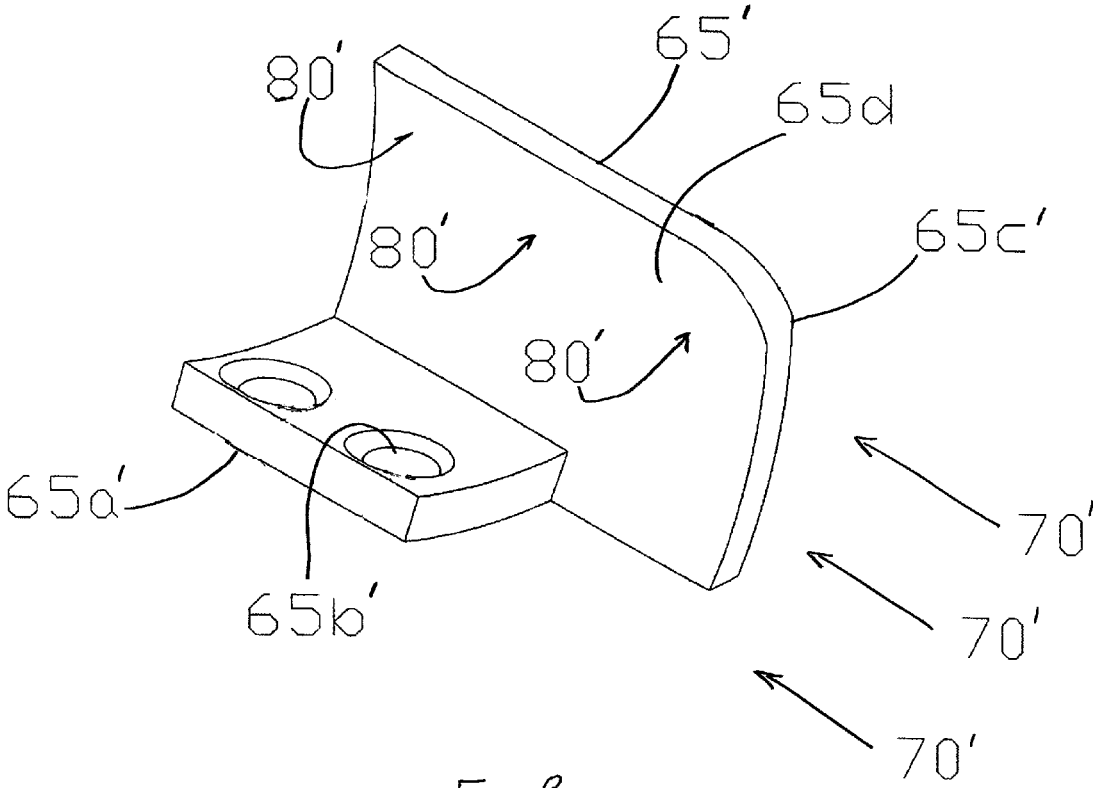
FIG. 8 is an illustration showing the direction of fluid across another embodiment of one of the replaceable secondary anti-rotation vanes.

FIG. 8 shows a representative replaceable vane 65' with mounting tab 65*a'* and mounting tab holes 65*b'* for securing the tab to the centrifugal pump suction cover 25'. The replaceable vane 65' includes a curved section 65*c'* at the entrance to the fluid flow 70' to prevent rags and stringy material from catching and accumulating on the surface. The anti-rotation vane 65' has a curved shape 65*d* opposite of the direction to the swirling fluid 80' to create vortices which counteract the low pressure zone in the center of the fluid flow 70'.

Figure 9:
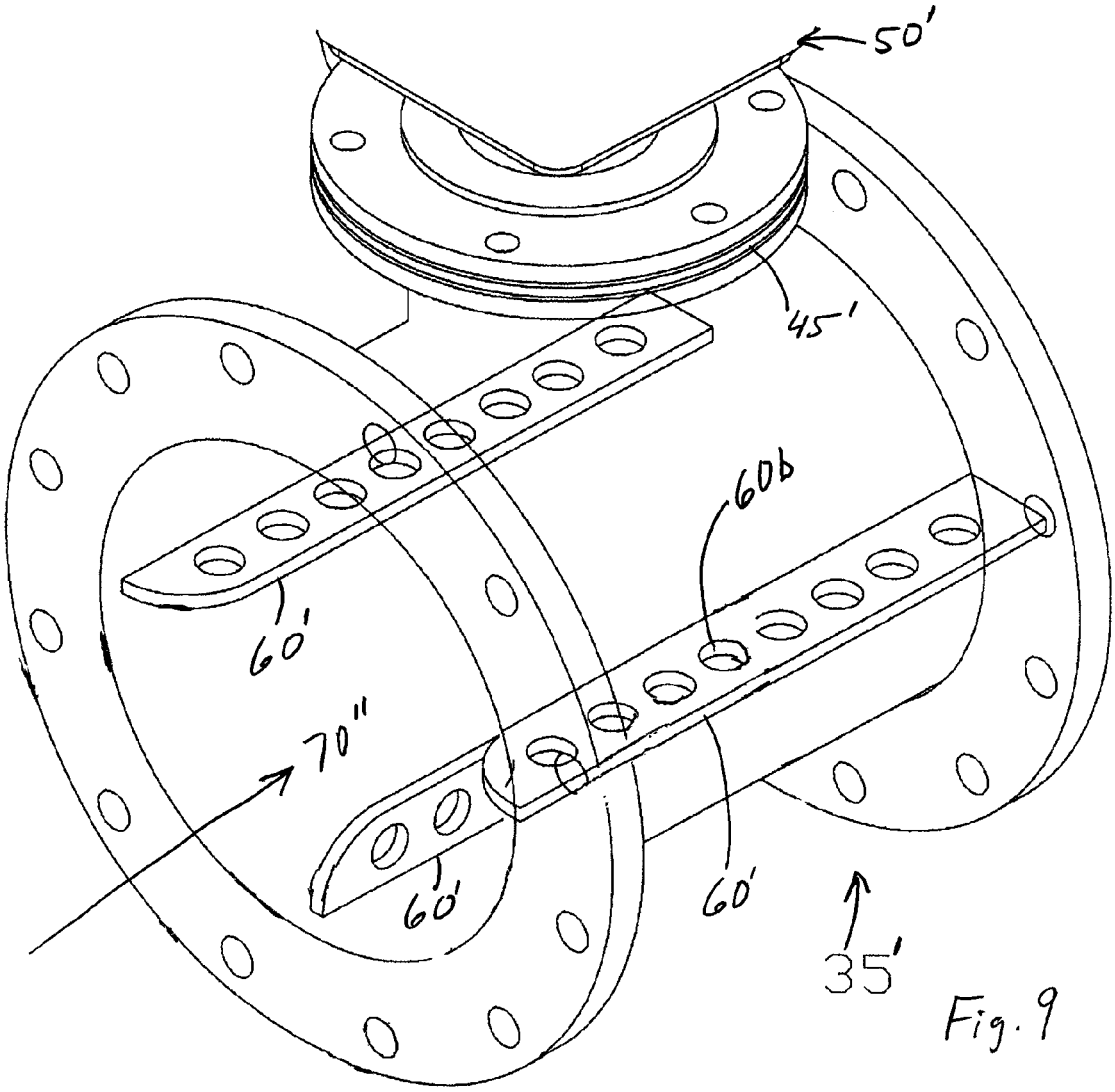
FIG. 9 is a partial view of another embodiment of the stationary primary anti-rotation vanes located in the lower section of the priming assembly.

FIG. 9 shows the general configuration of the stationary vanes 60' in the lower section 35' of the priming chamber assembly. The upper section 50' of the priming chamber assembly is also shown. Removable baffle 45' is shown intermediate the lower section 35' and the upper section 50'. The upper section 50' may be removed to clean elements of the lower section 35' with relative ease. Additionally, the removable baffle 45' keeps the fluid out of the upper section 50' which is part of the system which prevents the centrifugal pump from experiencing an air lock condition. It will be noted that a plurality of stationary anti-rotation vanes 60' are located at about the same angular displacement from each other as previously discussed. Also, the plurality of stationary anti-rotation vanes are joined to the wall of the lower section 35' projecting outward radially into the fluid flow 70'. The stationary anti-rotation vanes 60' include a plurality of apertures or holes 60*b* present along its length. The number of apertures 60*b* is determined by any of a variety of requirements of the centrifugal pump system 100 such as variances in the components thereof, such as the impeller, fluid flow rates, composition of air-fluid froth being pumped, as well as other dynamic fluid and pump material properties. Additionally, it has been considered to employ both stationary anti-rotation vanes 60 with the stationary anti-rotation vanes 60' when appropriate circumstances exist.

Figure 10:
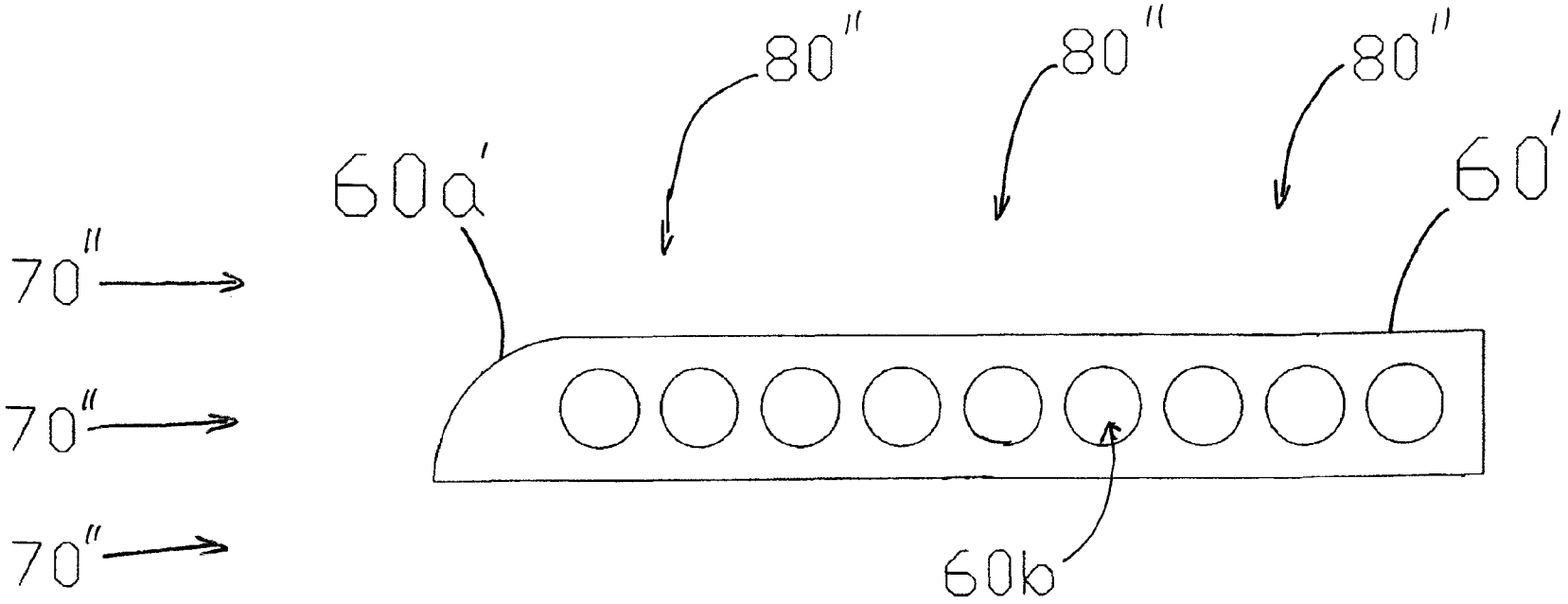
FIG. 10 is a schematic illustration showing the direction of fluid across another embodiment of a stationary primary anti-rotation vane located in the lower section of the priming assembly.

FIG. 10 shows a schematic of the stationary vanes 60' that are mounted in the lower section of the priming chamber whereby the vanes 60' have holes 60*b* located parallel to the swirling fluid 80" that create additional discrete vortices which counteract the low pressure zone in the center of the fluid flow 70". The stationary vane 60' includes a curved section 60*a'* at the entrance to the fluid flow 70" to prevent rags and stringy material from catching and accumulating on the surface.

Finally, it is to be understood that various alterations, modifications and/or additions may be incorporated into the various constructions and arrangements of parts without departing from the spirit or ambit of the invention. This includes, but is not limited to, the size, number and placement of both the primary and secondary vanes, the geometrical configuration of both the primary and secondary vanes, and the position of the components of the priming chamber assembly with respect to one another.

To recap, the invention is directed to a centrifugal pump for imparting a flow to a fluid which includes a priming chamber having an inlet for receiving a fluid, said priming chamber affixed to a centrifugal pump housing, said centrifugal pump housing including a centrally disposed rotating impeller therein, said centrifugal pump housing having an exit for discharging a fluid, a fluid flow path intermediate said inlet and said exit, said priming chamber having a cylindrical section with an air exit located through an opening through said cylindrical section, said cylindrical section having an interior wall, a plurality of primary vanes attached to said interior wall of said cylindrical section projecting into said fluid flow path toward said rotating impeller, whereby air present in a flowing fluid will be removed through said air exit.

Another way of stating the gist of the invention would be having a centrifugal pump which includes an intake plenum, said intake plenum have an intake plenum entrance and an intake plenum exit, a suction cover, said suction cover having a suction cover entrance and a suction cover exit, said intake plenum exit affixed to said suction cover entrance, a rotating impeller in a pump casing, said pump casing having a pump casing entrance and a pump casing exit, said suction cover exit affixed to said pump casing entrance, said intake plenum being cylindrical and having an interior cylindrical sidewall, said intake plenum having an air exit located through an opening through said cylindrical sidewall, a plurality of primary vanes, said primary vanes are affixed into said interior cylindrical sidewall, where said plurality of said primary vanes prevent air lock during operation of said centrifugal pump.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A centrifugal pump for imparting a flow to a fluid comprising:

a centrifugal pump housing having a rotating impeller disposed therein, said centrifugal pump housing having an exit for discharging a fluid, a priming chamber having an inlet for receiving a fluid, said priming chamber affixed to said centrifugal pump housing;

a fluid flow path intermediate said inlet and said exit;

said priming chamber having a cylindrical section with an air exit provided as an opening through said cylindrical section, said cylindrical section having an interior wall, a plurality of primary vanes attached to said interior wall of said cylindrical section, said plurality of primary vanes each having a height in a radial direction of said cylindrical section, said height being less than a radius of said cylindrical section, said plurality of primary vanes projecting into said fluid flow path toward said rotating impeller.

2. The centrifugal pump for imparting a flow to a fluid as claimed in claim 1 further comprising:

a suction cover located intermediate said priming chamber and said centrifugal pump housing, said suction cover having a cylindrical interior wall, a plurality of secondary vanes attached to said cylindrical interior wall projecting into said fluid flow path toward said rotating impeller.

3. The centrifugal pump for imparting a flow to a fluid as claimed in claim 2 wherein said priming chamber includes an entrance, and each of said plurality of primary vanes includes a rounded leading edge located proximal said entrance.

4. The centrifugal pump for imparting a flow to a fluid as claimed in claim 3 wherein each of said secondary vanes includes a rounded leading edge proximal said priming chamber.

5. The centrifugal pump for imparting a flow to a fluid as claimed in claim 3 wherein each of said secondary vanes includes an angular cut on a leading edge proximal said priming chamber.

6. The centrifugal pump for imparting a flow to a fluid as claimed in claim 3 wherein said each of said plurality of primary vanes has a plurality of apertures located there through.

7. The centrifugal pump for imparting a flow to a fluid as claimed in claim 3 wherein said air exit is located on a top of said priming chamber and said plurality of primary vanes number three, and are located at about 90 degrees, at about 180 degrees and at about 270 degrees in a clockwise fashion with respect to said top of said priming chamber, where said top of said priming chamber is located at about 0 (zero) degrees.

8. The centrifugal pump for imparting a flow to a fluid as claimed in claim 2 wherein each of said plurality of secondary vanes includes attachment means whereby any number of said plurality of secondary vanes greater than one may be affixed to said suction cover cylindrical interior wall.

9. The centrifugal pump for imparting a flow to a fluid as claimed in claim 2 wherein said air exit is located on a top of said priming chamber and said plurality of primary vanes number three, and are located at about 90 degrees, at about 180 degrees and at about 270 degrees in a clockwise fashion with respect to said air exit top opening, where said top of said priming chamber is located at about 0 (zero) degrees.

10. The centrifugal pump for imparting a flow to a fluid as claimed in claim 2 wherein said air exit is located on a top of said priming chamber and said plurality of secondary vanes number four, and are located at about 60 degrees, at about 150 degrees and at about 240 degrees and at about 330 degrees in a clockwise fashion with respect to said respect to said top of said priming chamber, where said top of said priming chamber is located at about 0 (zero) degrees.

11. The centrifugal pump for imparting a flow to a fluid as claimed in claim 2 wherein said plurality of secondary vanes number greater than four, and are located approximately at an equal angular distance from one another.

12. The centrifugal pump for imparting a flow to a fluid as claimed in claim 2 wherein each of said plurality of secondary vanes are curved.

13. A centrifugal pump for imparting a flow to a fluid comprising:

a priming chamber having an inlet for receiving a fluid, said priming chamber affixed to a centrifugal pump housing, said centrifugal pump housing including a centrally disposed rotating impeller therein, said centrifugal pump housing having an exit for discharging a fluid, a fluid flow path intermediate said inlet and said exit, said priming chamber having a cylindrical section with an air exit provided as an opening through said cylindrical section, said cylindrical section having an interior wall, a plurality of primary vanes attached to said interior wall of said cylindrical section projecting into said fluid flow path toward said rotating impeller, for removing air present in a flowing fluid through said air exit;

an entrance to said centrifugal pump housing, said entrance having cylindrical sidewall, a plurality of secondary vanes attached to said cylindrical sidewall projecting into said fluid flow path toward said rotating impeller.

14. The centrifugal pump as claimed in claim 13 wherein each of said plurality of secondary vanes are curved.

15. The centrifugal pump for imparting a flow to a fluid as claimed in claim 13 wherein each of said plurality of secondary vanes includes attachment means whereby any number of said plurality of secondary vanes greater than one may be affixed said entrance of said centrifugal pump housing.

16. The centrifugal pump for imparting a flow to a fluid as claimed in claim 13 wherein said air exit is located on a top of said priming chamber and said plurality of primary vanes number three, and are located at about 90 degrees, at about 180 degrees and at about 270 degrees in a clockwise fashion with respect to said top of said priming chamber, where said top of said priming chamber is located at about 0 (zero) degrees.

17. The centrifugal pump for imparting a flow to a fluid as claimed in claim 1 wherein each of said plurality of primary vanes has a plurality of apertures located there through.

18. The centrifugal pump for imparting a flow to a fluid as claimed in claim 1 wherein said air exit is located on a top of said priming chamber and said plurality of primary vanes number three, and one of each said plurality of primary vanes are located at about 90 degrees, at about 180 degrees and at about 270 degrees in a clockwise fashion with respect to said top of said priming chamber, where said top of said priming chamber is located at about 0 (zero) degrees.

19. A centrifugal pump comprising;

an intake plenum, said intake plenum having an intake plenum entrance and an intake plenum exit, said intake plenum being cylindrical and having an interior cylindrical sidewall, said intake plenum having an air exit provided as an opening through said cylindrical sidewall, a pump casing having a rotating impeller, said pump casing having a pump casing entrance and a pump casing exit, a plurality of primary vanes, said primary vanes being affixed to said interior cylindrical sidewall, said plurality of primary vanes each having a height in a radial direction of said cylindrical section, said height being less than a radius of said cylindrical section.

20. The centrifugal pump as claimed in claim 19 wherein said plurality of said primary vanes each have a first side proximal said intake plenum entrance, and each of said first side of said primary vanes are rounded.

21. The centrifugal pump as claimed in claim 20 wherein said air exit is located on a to portion of said intake plenum.

22. The centrifugal pump as claimed in claim 21 further comprising: a suction cover, said suction cover having a suction cover entrance and a suction cover exit;

said intake plenum exit being affixed to said suction cover entrance;

said suction cover exit being affixed to said pump casing entrance;

said suction cover is cylindrical and includes an interior cylindrical sidewall with a plurality of secondary vanes affixed into said suction cover interior cylindrical sidewall.

23. The centrifugal pump as claimed in claim 22 wherein said plurality of primary vanes includes a first primary vane, a second primary vane and a third primary vane.

24. The centrifugal pump as claimed in claim 23 wherein said first primary vane is located at about the 90 degrees clockwise of said air exit, said second primary vane is located at about 90 degrees clockwise from said first primary vane, and said third primary vane is located at about 90 degrees clockwise from said second primary vane.

25. The centrifugal pump as claimed in claim 24 wherein said first primary vane, said second primary vane and said third primary vane extend from out said intake plenum entrance to about said intake plenum exit.

26. The centrifugal pump as claimed in claim 25 wherein said plurality of secondary vanes includes a first secondary vane, a second secondary vane, a third secondary vane and a fourth secondary vane.

27. The centrifugal pump as claimed in claim 26 wherein suction cover includes a topmost element, said first secondary vane is located at about 60 degrees clockwise of said topmost element, said second secondary vane is located at about 90 degrees clockwise from said first secondary vane, said third secondary vane is located at about 90 degrees clockwise from said second secondary vane, and said fourth secondary vane is located at about 90 degrees clockwise from said third secondary vane.

28. The centrifugal pump as claimed in claim 27 wherein said first secondary vane, said second secondary vane, said third secondary vane and said fourth secondary vane each include a mounting pad generally perpendicular to each of said plurality of secondary vanes, and said mounting pads are adjacent said suction cover interior cylindrical sidewall, and said mounting pads further include a curvature to align snugly against said suction cover interior cylindrical sidewall, and further, said mounting pads include at least one aperture, said at least one aperture permitting at least one mechanical fastener to secure said mounting pads to said suction cover interior cylindrical sidewall, and to further allow any of, some of, or all of, said first secondary vane, said second secondary vane, said third secondary vane and said fourth secondary vane to be removed or replaced.

29. The centrifugal pump as claimed in claim 28 wherein said first secondary vane, said second secondary vane, said third secondary vane and said fourth secondary vane extend from about said suction cover entrance to about said suction cover exit.

30. The centrifugal pump as claimed in claim 22 wherein said plurality of secondary vanes have a plurality of secondary vanes first sides proximal said suction cover entrance, said plurality of secondary vanes first sides having each a curved portion.

31. The centrifugal pump as claimed in claim 20 wherein each of said plurality of primary vanes extend a first length from about said intake plenum entrance to about said intake plenum exit.

32. The centrifugal pump as claimed in claim 31 wherein each of said plurality of primary vanes includes a plurality of apertures thereon, said plurality of said apertures being linearly disposed in a side by side relation along said each of said plurality of primary vanes.

33. The centrifugal pump as claimed in claim 22 wherein said plurality of primary vanes are proximal to said plurality of secondary vanes.

34. The centrifugal pump as claimed in claim 22 wherein said suction cover includes a suction cover interior cylindrical sidewall, and further, said suction cover interior cylindrical sidewall includes a plurality of secondary vanes affixed to said suction cover interior cylindrical sidewall and orientated with said flowing fluid, wherein said plurality of secondary vanes are inwardly curved.

* * * * *